United States Patent [19]

Mount

[11] 4,451,725

[45] May 29, 1984

[54] ELECTRICAL HEATING UNIT FOR SEALING VACUUM ELECTRON TUBES

[75] Inventor: James Mount, Lancaster, Pa.

[73] Assignee: RCA Corporation, New York, N.Y.

[21] Appl. No.: 400,620

[22] Filed: Jul. 22, 1982

[51] Int. Cl.[3] ..... F27B 5/14; F27D 11/02

[52] U.S. Cl. ..... 219/390; 165/185; 219/386; 219/530; 219/535; 432/249

[58] Field of Search ..... 219/385, 386, 523, 390, 219/535, 550; 165/185, 80; 49/57; 250/27.5; 432/249, 253

[56] References Cited

U.S. PATENT DOCUMENTS

| | | | |
|---|---|---|---|
| 2,278,500 | 4/1942 | Smith | 250/27.5 |
| 2,986,846 | 6/1961 | Clarke et al. | 49/57 |
| 3,002,076 | 9/1961 | Massey | 219/535 |
| 3,100,251 | 8/1963 | Johnson | 219/390 |
| 4,055,219 | 10/1977 | Orlandi et al. | 219/390 |

*Primary Examiner*—Volodymyr Y. Mayewsky
*Attorney, Agent, or Firm*—E. M. Whitacre; D. H. Irlbeck; L. Greenspan

[57] ABSTRACT

Electrical heating unit for tipping-off vacuum electron tubes comprises a cylindrical resistance heating coil, a cylindrical heat-shielding means within and spaced from the heating coil and a support plate adjacent one end of the coil permitting leads of a vacuum tube to be positioned within the heat-shielding means. The heat-shielding means comprises a unitary member having a hollow cylindrical body, an outwardly-extending flange at one end of the body, and an inwardly-extending flange at the other end of said body adapted to support the leads of said vacuum tube with the tubulation of the tube extending therethrough. The body has a height that is less than the height of the longest lead of the vacuum tube.

4 Claims, 4 Drawing Figures

ELECTRICAL HEATING UNIT FOR SEALING VACUUM ELECTRON TUBES

BACKGROUND OF THE INVENTION

This invention relates to a novel electrical heating unit for use in sealing vacuum electron tubes and particularly, but not necessarily exclusively, for tipping-off cathode-ray tubes immediately after they are exhausted of gases.

In the manufacture of vacuum electron tubes, it is a common practice to provide an evelope having a small glass exhaust tubulation. During the manufacture of the tube, the envelope is exhausted of gases through the tubulation. Then, the tubulation is heated to melt the glass at a location that is close to the external surface of the envelope. The molten glass necks in, closing the path therethrough, and thereby seals the interior of the envelope from the ambient. This sealing of the tubulation is referred to in the art as "tipping-off." After the glass has cooled, the excess tubulation is cracked off at the seal.

In many types of tubes, including most cathode-ray tubes, the exhaust tubulation is integral with the stem of the tube. The stem includes a glass disc or wafer having a circular array of electrically-conducting leads sealed into, and extending out from, the wafer, with the exhaust tubulation usually disposed centrally of, and within the array of, the leads. The glass of the wafer is usually thicker adjacent each lead, which thickening is referred to as a "fillet".

A typical heating unit used for tipping-off exhaust tubulations comprises a cylindrical electrical resistance heater coil sized to fit symmetrically around the outside of the circular array of leads, with the stem of the tube resting on the top of the endwall of the unit. One type of heater unit, described in U.S. Pat. No. 3,002,076 issued Sept. 26, 1961 to M. K. Massey, includes separate metal straps that function as heat shields between each lead and the heater coil in a circular array. Factory use of the prior heater units has been satisfactory generally, although an undesirable percentage of tubes has exhibited cracked fillets and/or nonsymmetrical melting of the exhaust tubulation. Fewer tubes are rejected for these causes when tipped-off with the novel unit.

SUMMARY OF THE INVENTION

The novel unit is similar in principle to the prior units described above except that the heat shield is a unitary body of heat-conducting material including a hollow cylindrical main body, an inwardly-extending flange at one end thereof and an outwardly-extending flange at the other end thereof. The wall of the main body is shorter than the length of the longest lead and may be solid or apertured. The inwardly-extending flange has an aperture therethrough that is large enough for the tubulation to pass through but smaller than the diameter of the circle of leads through the stem. The outwardly-extending flange is adapted to rest on the upper endwall of the unit.

When a tube is inserted into the unit, the longest lead, or leads, rests on the lower flange, which holds the stem away from the endwall of the unit. By spacing the stem from the top of the unit, less heat is transferred therebetween by conduction, resulting in less stress in the glass stem, particularly at the fillets, resulting in fewer cracked fillets.

When the coil is activated, the main body of the heat shield intercepts heat radiated from the coil and conducts it to the inwardly-extending flange, where it is reradiated to a small concentrated area of the tubulation from the closely-spaced inner diameter of the inwardly-extending flange. This geometry is more tolerant of variations in the position of the tubulation relative to the heater resulting in more symmetrical heating of the tubulation. Preferably, the heat shield extends only partially into the heater coil, whereby a portion of the tubulation outside the heat shield is heated directly by radiation from the heater coil.

DETAILED DESCRIPTION OF THE PREFERRED EMBODIMENT

Figure 1:
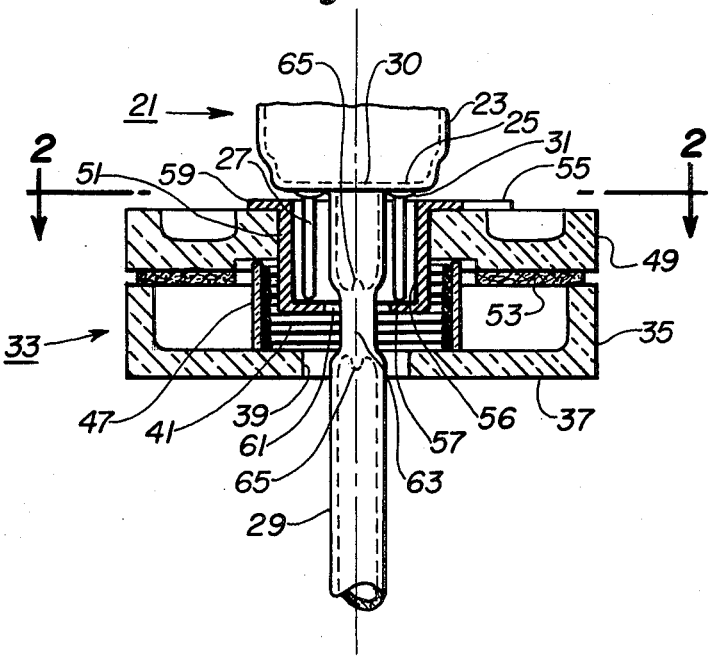
FIG. 1 is a sectional elevational view of a preferred embodiment of the invention with a glass tubulation in position just after it was tipped off.
Figure 2:
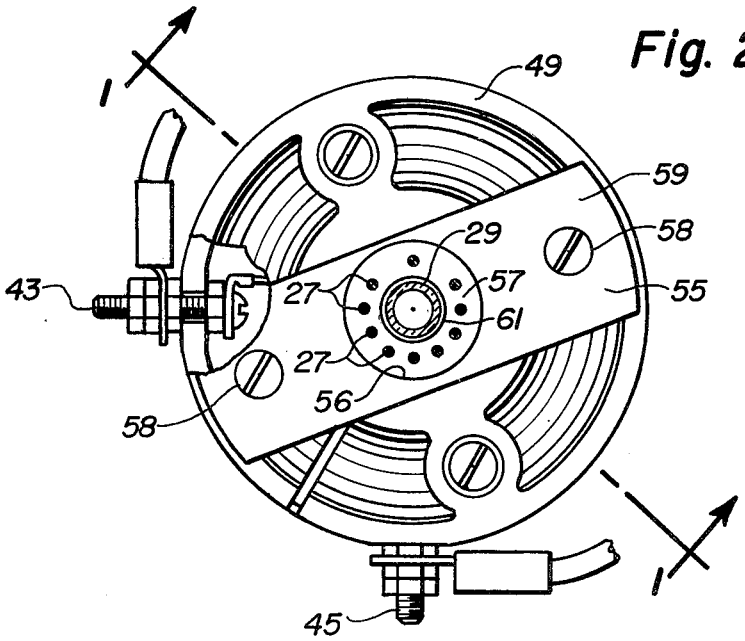
FIG. 2 is a partially broken-away, sectional plan view of the preferred embodiment viewed along section lines 2—2 of FIG. 1.

In FIGS. 1 and 2, a portion of a CRT (cathode-ray tube) 21 that is suitable for tipping-off with the novel electrical unit is shown. The portion shown includes a tubular neck 23 which is closed at one end by a glass wafer 25 in which a circular array of substantially parallel electrically-conducting leads 27 is sealed into and extends outwardly from the wafer 25. A round glass exhaust tubulation 29 is sealed into the wafer 25 concentrically within the array of leads 27 and provides a passage 30 through the wafer 25 for exhausting the interior of the tube 21 of gases. There are glass fillets 31 around each of the leads 27.

That portion of the CRT 21 is positioned on a preferred embodiment of the novel electrical heating unit 33. The unit 33 comprises a cylindrical ceramic cup 35 that is open at its upward-facing end and closed at its other end by an endwall 37 having a central endwall aperture 39 therein whose diameter is larger than the diameter of the tubulation 29. A resistance heater coil 41 (FIG. 1) comprising a plurality of helical turns of wire rests on the inner surface of the endwall 37 and is substantially concentric with the endwall aperture 39 of the cup 35. The wire of the coil 41 may be wound in other arrangements; for example, back-and-forth parallel to the length of the tubulation 29. There are electrical connections 43 and 45 (FIG. 2) through the sidewall of the cup 35 for applying a desired voltage to the coil 41. A cylindrical ceramic heater retainer 47 (FIG. 1) is located concentrically around the coil 41. A circular cover plate 49 having a central cover-plate aperture 51 that is substantially concentric with the coil 41 rests on top of the cup 35 with a ceramic spacer 53 therebetween.

Figure 3:
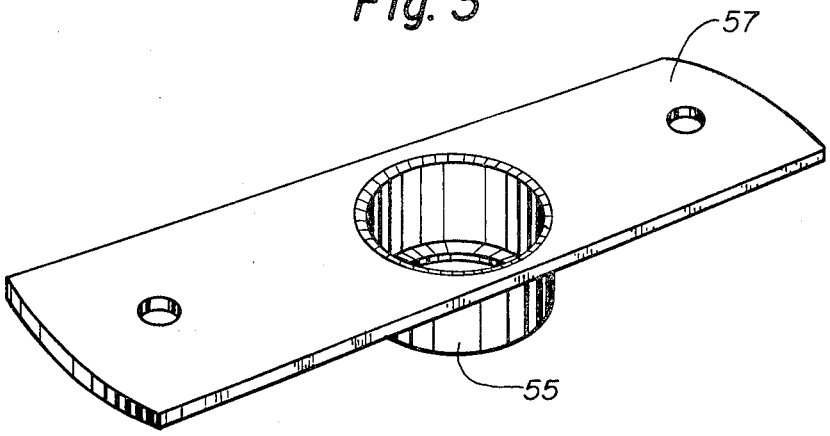
FIG. 3 is a perspective view of the solid-wall heat shield employed in the preferred embodiment shown in FIGS. 1 and 2.

A cup-shaped heat shield 55, shown in perspective in FIG. 3, comprises a cylindrical sidewall 56 having an integral endwall 57. The heat-shield sidewall 56 fits loosely within the cover-plate aperture 51 and within the coil 41 and is supported from an integral outwardly-extending flange 59 that rests on the top of the cover plate 49, and is held in place by screws 58. The endwall 57 of the heat shield 55 is an inwardly-extending flange that has a central aperture 61 which is larger in diameter than the diameter of the tubulation 29 and is substantially concentric with the coil 47. The interior depth of the heat-shield sidewall 56 is less than the lengths of the leads 27 outside the glass wafer 25, so that when the leads 27 of a CRT rest on the heat-shield endwall 57, the wafer 25 and fillets 31 are spaced from the top of the heat shield 55. Also, the heat-shield endwall 57 is spaced from the endwall 37 of the cup 35 so that a portion of the coil 47 radiates directly to both the heat-shield sidewall 56 and the tubulation 29.

The preferred embodiment may be used by the following procedure. The tubulation 29 of a CRT is carefully passed downward through the heat-shield aperture 61 and the ceramic-cup aperture 39 until the ends of the leads 27 come the rest on the heat-shield endwall 57. Connections are made to the tubulation 29, and the CRT is exhausted of gases, typically to a vacuum of about $10^{-5}$ torr. The CRT may be baked at temperatures up to about 400° C. during the period when the CRT is being exhausted. With the CRT held at vacuum, a voltage is applied across the coil 41 to bring the coil to bright red heat. The heat shield 55 shields the leads 27 from overheating and, at the same time, concentrates heat on the tubulation 29 at and below the heat-shield aperture 61. This heat and direct radiation from the coil cause the glass of the tubulation 29 in that region to melt, whereby the ambient atmospheric pressure collapses the molten glass as shown in FIG. 1, closing and sealing the passage through the tubulation 29 with a tip-off seal 63. The voltage is then removed, the tubulation 29 is cooled, and the tube is removed from the unit 33. A small protuberance of glass 65 referred to as a "ball" forms at each end of the molten portion centrally inside the tubulation. The formation of a ball at each end of the seal shows that a low-strain, symmetrical seal has been produced. Prior to or after the CRT is removed from the unit, the excess tubulation is removed by making a small scratch on the outside of the seal and then cracking the tubulation at the scratch. Inspection of the fillets 31 shows a marked reduction of cracking and chipping at this location. This is attributed to adequate shielding from heat which results from spacing the wafer 25 from the unit 33.

Figure 4:
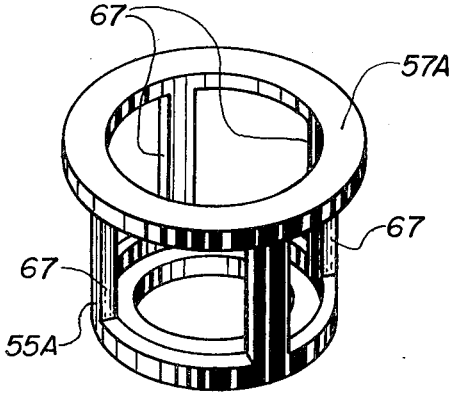
FIG. 4 is a perspective view of an apertured-wall heat shield that may be employed in the novel electrical unit.

While the heat-shield in the preferred embodiment shown in FIGS. 1 to 3 has a solid cylindrical wall and a long, outwardly-extending flange 57, neither feature is critical. As shown in FIG. 4, the cylindrical wall of an alternative heat shield 55A may have apertures 67. Also, the outwardly-extending flange 57A may be narrow. The alternative heat shield 55A fits loosely in the unit by gravity and is not held with screws. The height of the heat-shield sidewall in all of the alternatives may be varied. The shorter the height of the heat-shield sidewall within limits, the greater will be the spacing between the stem wafer 25 and the top of the heat shield and the larger will be the tubulation between the stem wafer 25 and the tip-off seal 63.

What is claimed is:

1. An electrical heating unit for sealing vacuum electron tubes of the type having a glass stem, a glass exhaust tubulation extending from said stem and a plurality of electrically-conducting leads extending from said stem in a circular array around said tubulation, said unit including (a) a cylindrical resistance heating coil, (b) an electrically-insulating support for said coil, (c) cylindrical heat-shielding means located within and spaced from said heating coil in a substantially concentric relationship, (d) a support plate adjacent one end of said coil and having an aperture therein permitting said leads to be positioned within said heat-shielding means, (e) and means for securing elements (a) through (d) together as a unit.

characterized in that said heat-shielding means comprises a unitary member of heat-conducting material including (i) a hollow cylindrical body adapted to receive said leads therein, (ii) an outwardly-extending flange at one end of said body and (iii) an inwardly-extending flange at the other end of said body, said outwardly-extending flange having an outer size that is larger than said support plate aperture, said inwardly-extending flange having an inner size that is smaller than the diameter of said circular array of leads and larger than the diameter of said tubulation, and said body has a height that is less than the length of the longest of said leads.

2. The unit defined in claim 1 wherein the walls of said main body have apertured portions therein.

3. The unit defined in claim 1 wherein the walls of said main body are solid and unapertured.

4. The unit defined in claim 1 wherein said heat-shielding means extends partially into said heating coil.

* * * * *